US005203033A

United States Patent [19]

Sheppard, Sr. et al.

[11] Patent Number: 5,203,033

[45] Date of Patent: Apr. 20, 1993

[54] CAMOUFLAGED GARMENT

[76] Inventors: David L. Sheppard, Sr., 7 Pine Lake Dr.; David L. Sheppard, Jr., 1708 Wansley Rd.; Christopher Sheppard, 7 Pine Lake Dr., all of Laurel, Miss. 39440

[21] Appl. No.: 735,745

[22] Filed: Jul. 25, 1991

[51] Int. Cl.[5] ..... A41D 27/08

[52] U.S. Cl. ..... 2/69; 2/94; 2/244

[58] Field of Search ..... 2/69, 94, 101, 115, 2/202, 244, 75, 80

[56] References Cited

U.S. PATENT DOCUMENTS

| | | | |
|---|---|---|---|
| 530,130 | 12/1894 | Schwarz . | |
| 706,464 | 8/1902 | Spurgin . | |
| 1,994,659 | 3/1935 | Mascaenhas . | |
| 2,351,142 | 6/1944 | Mitchell . | |
| 3,069,796 | 12/1962 | Küter . | |
| 3,928,712 | 12/1975 | Sears . | |
| 4,221,024 | 9/1980 | Becker . | |
| 4,249,268 | 2/1981 | Berler | 2/115 |
| 4,285,068 | 8/1981 | Ross | 2/202 |
| 4,517,230 | 5/1985 | Crawford . | |
| 4,792,491 | 12/1988 | Lee . | |
| 4,885,805 | 12/1989 | Mason | 2/244 |
| 4,947,489 | 8/1990 | Greenwood | 2/101 X |
| 4,975,987 | 12/1990 | Teachont et al. | 2/244 X |
| 5,001,782 | 3/1991 | Stewart | 2/243 B |
| 5,010,589 | 4/1991 | Hamilton | 2/94 X |

FOREIGN PATENT DOCUMENTS

| | | | |
|---|---|---|---|
| 751202 | 8/1933 | France | 2/244 |
| 12715 | 9/1915 | United Kingdom | 2/206 |

*Primary Examiner*—Clifford D. Crowder
*Assistant Examiner*—Jeanette E. Chapman
*Attorney, Agent, or Firm*—David H. Semmes

[57] ABSTRACT

Camouflaged garments of the type used by hunters, outdoorsmen and the like. Particularly, a garment having a plurality of elongated connectors secured at each end so as to form connector loops extending outwardly of the garment. The camouflage element consists of a pair of simulated leaves having a common stem, such that a simulated leaf extends from each end of the stem. The stem is flexible so that it may be interlocked with the connector loop and thereby releasably support the simulated leaves on the outside of the garment. The leaves are characterized by their simplicity of construction and the ease of interchangeability depending upon the change of seasons or habitat.

3 Claims, 2 Drawing Sheets

CAMOUFLAGED GARMENT

BACKGROUND OF THE INVENTION

1. Field of the Invention

Camouflaged garments particularly garments having exterior connector loops for releasably supporting a plurality of simulated leaf camouflage elements.

2. Description of the Prior Art

| Inventor: | Patent No: |
|---|---|
| SCHWARZ | 530,130 |
| SPURGIN | 706,464 |
| MASCARENHAS | 1,994,659 |
| MITCHELL | 2,351,142 |
| BECKER | 4,221,024 |
| CRAWFORD | 4,517,230 |
| LEE | 4,792,471 |
| RÜTER | 3,069,796 |
| SEARS | 3,928,712 |

The aforelisted patents suggest hunting garments adapted for camouflage by the employment of "Velcro"-type and other fasteners for removably supporting camouflage elements. However, none suggest applicants' twin leaf stem which is removably connected by double looping to the hunter's exterior garment.

SUMMARY OF THE INVENTION

According to the present invention, applicants have provided a garment material conformed to fit the human body. A plurality of connectors are secured at each end to the garment such that the connectors form flexible and twistable loops extending outwardly of the garment. There are provided pairs of simulated leaves having a common stem such that a simulated leaf extends from each end of the common stem. The common stem is flexed so as to form a stem loop which is extensible through the connector loop with the pair of leaves being drawn together and pulled through the stem loop binding non-slip attachment with the connector loop. As a result, the hunter's garment may be worn with or without camouflage. The simulated leaf camouflage when applied may be adapted to seasonal leaf coloring and configuration.

DESCRIPTION OF THE PREFERRED EMBODIMENTS

Figure 1:
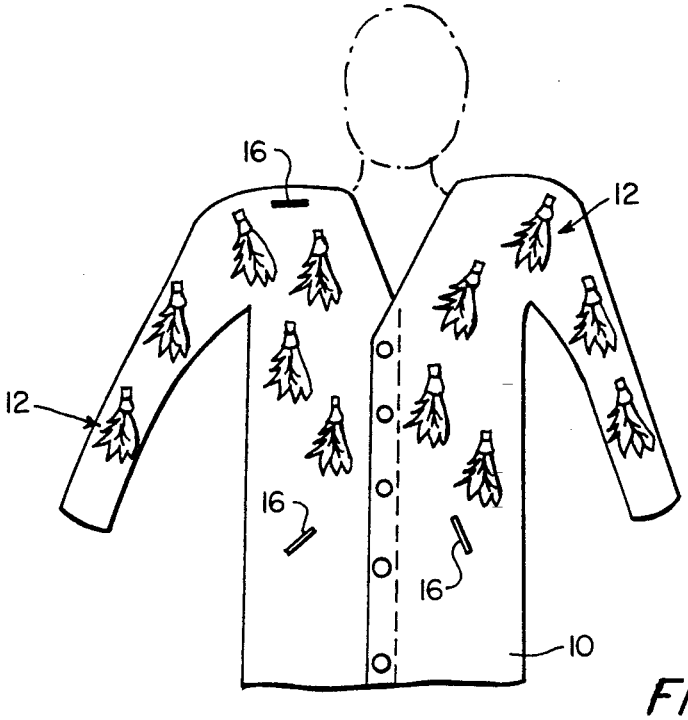
FIG. 1 is a front elevation of a hunter's garment with exterior connector loops and pairs of camouflaged leaves interlocked with the connector loops.

In FIG. 1 a hunter's garment 10 is shown as having a plurality of removable camouflage devices 12 secured to individual, flexible and twistable connector loops 16.

Figure 2:
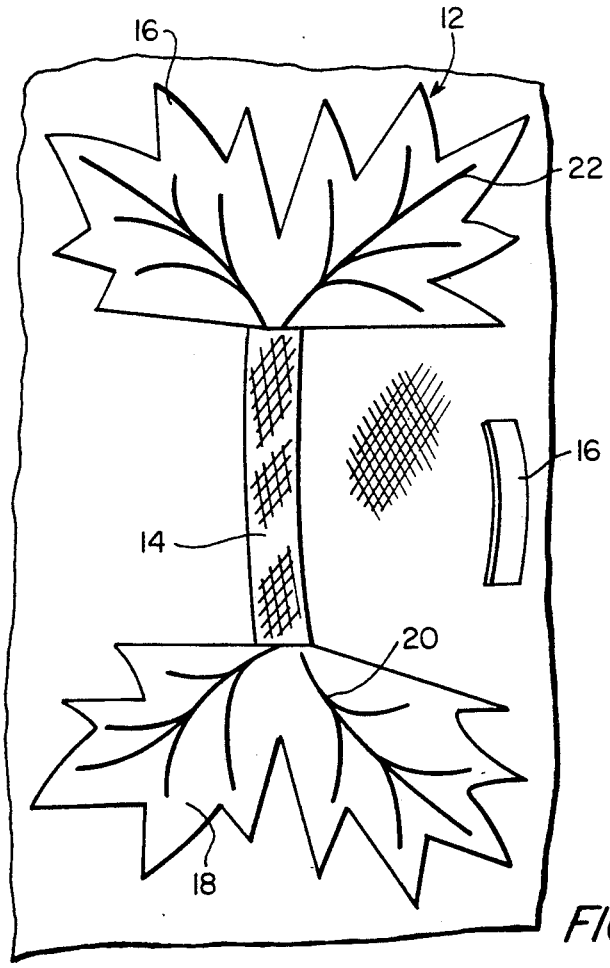
FIG. 2 is a enlarged front elevation of the pairs of leaves, having a common stem, supported adjacent the exterior connector loop.

In FIG. 2, the camouflage elements 12 are shown as embodying pairs of simulated leaves 17, 18 affixed at opposite ends of an axially extending common stem 14. The individual leaves may have spine elements 20, 22, so as to simulate various types of foliage. A connector 16 is shown as secured at either end to the surface of the garment so as to form a loop extending outwardly of the garment.

Figure 3:
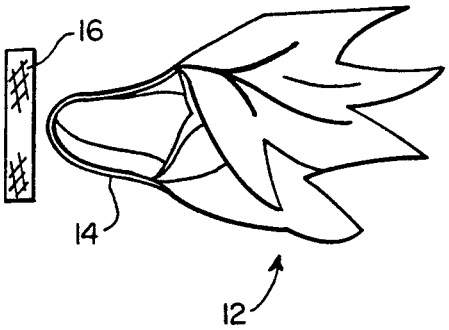
FIG. 3 is a front elevation showing bending of the common stem so as to form a stem loop prior to insertion within the connector loop.
Figure 4:
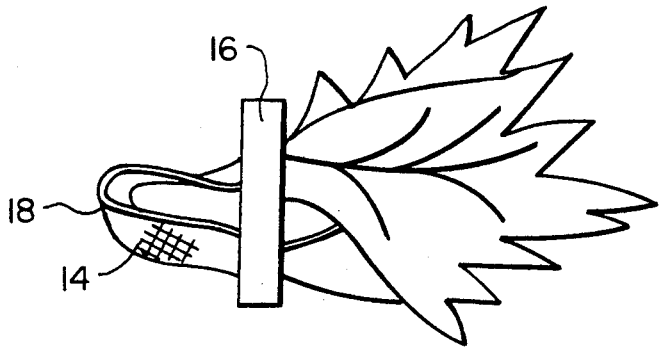
FIG. 4 is front elevation showing movement of the common stem loop through the connector loop.

In FIGS. 3 and 4, common stem 14 is shown bent into a loop configuration 18 extensible through connector loop 16.

Figure 5:
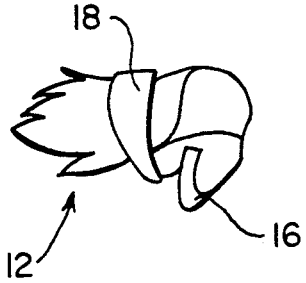
FIG. 5 is a front elevation showing bunching of the pairs of simulated leaves together and pulling the pairs through the stem loop so as to lock the simulated leaves to the connector loop.

In FIG. 5, the simulated leaf elements 17, 18 are shown as bunched together so as to be drawn through connector loop 16, such that stem loop 14 and connector loop 16 interlock and support the camouflage element 12 on the exterior of the garment.

Figure 6:
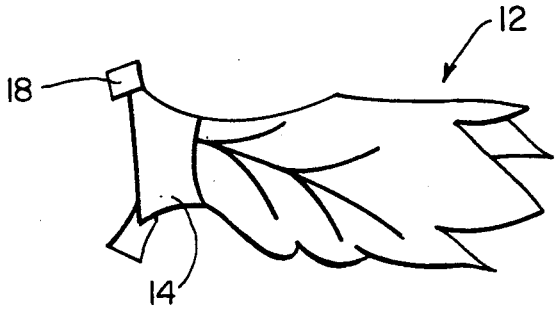
FIG. 6 is a front elevation of the securement of the pairs of simulated leaves by interlocking of the stem loop 14 and connector loop 16.
Figure 7:
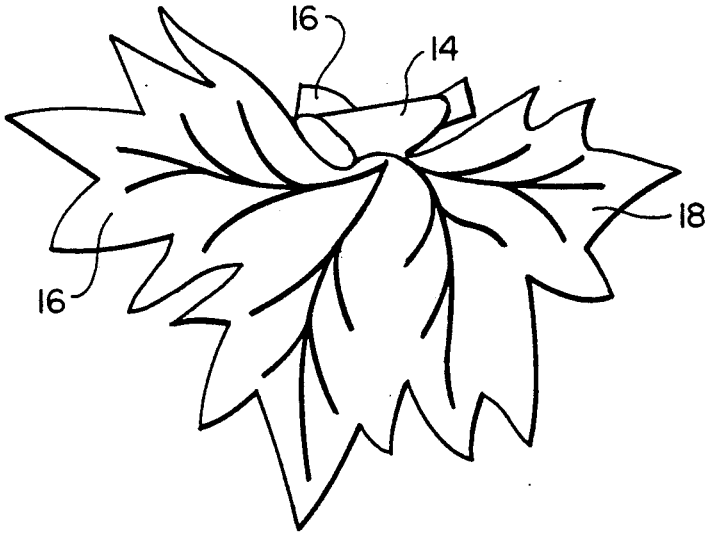
FIG. 7 is a front elevation showing the disposition of the pairs of leaves after securement.

In FIG. 6, the interlocked configuration is shown and in FIG. 7, the individual leaf elements 17, 18 are shown as displayed in typical camouflage array.

Manifestly, camouflage elements 12 may be configured so as to have a single leaf configuration at each end of flexible stem 14 or a double leaf configuration, as illustrated in FIG. 2. Also, the leaves may be colored and configured in adjustment to the changing Spring, Summer, Autumn and Winter seasons. The individual connector loops may be variously secured to garment 10. However, a simple stitching of a loop element 16 at each end should suffice.

We claim:

1. A clothing garment adaptable for camouflage effect comprising:

a) a garment material conformed to fit the human body;

b) a plurality of elongated deformable connectors secured at respective ends to said garment so as to define flexible and twistable connector loops extending outwardly of said garment material, and c) at least one pair of simulated leaves attached to one of said connector loops, each pair having an axially extending common stem, such that a simulated leaf extends from each end of said stem, said stem likewise being flexible and deformable the attachment of said pair to said connector loop being in the form of a stem loop extensible through said flexible and twistable connector loop with said pair of leaves being drawn together and pulled through said stem loop for double looping and binding non-slip attachment to the flexible connector loop.

2. A clothing garment as in claim 1, each said pair of leaves being formed such that a leaf of each pair is positioned at each end of said common stem.

3. A clothing garment as in claim 1, a pair of simulated leaves being formed at each end of said common stem, such that two opposed pairs of leaves are supported adjacent each said connector loop.

* * * * *